US006442954B1

(12) United States Patent
Shapiro et al.

(10) Patent No.: US 6,442,954 B1
(45) Date of Patent: Sep. 3, 2002

(54) DUAL HOPPER ICEMAKING REFRIGERATOR

(75) Inventors: Andrew Philip Shapiro, Schenectady; Steve Paraszczak, Clifton Park; Jerome Johnson Tiemann, Schenectady, all of NY (US); Lorina June White; Martin Scott Mershon, both of Louisville, KY (US); Scott Russell King, Prospect, KY (US); Samuel Vincent DuPlessis, Louisville, KY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/895,121

(22) Filed: Jul. 2, 2001

(51) Int. Cl.[7] ..... F25C 5/18
(52) U.S. Cl. ..... 62/137; 62/344
(58) Field of Search ..... 62/137, 344

(56) References Cited

U.S. PATENT DOCUMENTS 4,285,212 A * 8/1981 Prada ..... 141/358
4,300,359 A * 11/1981 Koeneman et al. ..... 62/344
4,771,609 A * 9/1988 Funabashi ..... 62/137
5,037,004 A * 8/1991 Katz et al. ..... 222/146.6
5,211,030 A * 5/1993 Jameson ..... 222/561
5,655,386 A * 8/1997 Huang et al. ..... 62/320
6,050,097 A 4/2000 Nelson et al. ..... 62/137
6,082,130 A 7/2000 Pastryk et al. ..... 62/344

* cited by examiner

*Primary Examiner*—William E. Tapolcai
(74) *Attorney, Agent, or Firm*—Patrick K. Patnode; Christian G. Cabou

(57) ABSTRACT

A refrigerator includes a freezer compartment and access door. An icemaker is disposed in the freezer compartment. An upper hopper is disposed inside the freezer door below the icemaker, and includes a rotary auger and first and second ice ports below opposite ends thereof. A receptacle is disposed outside the freezer door below the upper hopper, and a lower hopper is disposed inside the freezer door below the receptacle. A chute joins the second port of the upper hopper to the lower hopper for storing ice cubes therein.

19 Claims, 5 Drawing Sheets

DUAL HOPPER ICEMAKING REFRIGERATOR

BACKGROUND OF THE INVENTION

The present invention relates generally to refrigerators, and, more specifically, to icemaking therein.

In a typical side-by-side refrigerator, a refrigeration compartment is disposed to the right, and a freezer compartment is disposed to the left, with corresponding doors therefor. A common compressor is used for compressing a refrigerant which expands in a closed circuit for removing heat from the two compartments.

The freezer compartment typically includes shelves therein as well as inside the freezer door for maintaining frozen typical food products. An automatic icemaker is commonly found at the top of the freezer compartment for producing ice cubes which are stored in a hopper.

A motor driven auger is disposed at the bottom of the hopper and is rotated for dispensing ice cubes through a bottom outlet port thereof. A convenience receptacle is provided in the outside of the freezer door, and is aligned with the hopper port for dispensing ice cubes through the receptacle without opening the freezer door. The receptacle typically also includes a water dispenser for conveniently providing water chilled inside the refrigerator.

The icemaker typically requires a relatively large volume inside the freezer compartment for making, storing, and dispensing ice cubes. The ice cubes are made in an icetray located near the top of the freezer compartment, and are automatically discharged therefrom and fall into the hopper. When the hopper is filled with ice cubes to the level of the icetray, a wire bail is lifted by the mass of cubes for activating an electrical switch and preventing farther icemaking until the level of ice cubes drops in the hopper. Even at the hopper fill level, substantial open space is still found at the top of the hopper adjacent to the icemaker.

The volume occupied by the icemaker is correspondingly not available for storing frozen food. And, unused space inside the icemaker further eliminates available space for storing frozen food.

Accordingly, it is desired to provide an improved icemaker which better utilizes the limited volume of the freezer compartment for ice production to increase volume available for storing frozen food.

BRIEF SUMMARY OF THE INVENTION

A refrigerator includes a freezer compartment and access door. An icemaker is disposed in the freezer compartment. An upper hopper is disposed inside the freezer door below the icemaker, and includes a rotary auger and first and second ice ports below opposite ends thereof. A receptacle is disposed outside the freezer door below the upper hopper, and a lower hopper is disposed inside the freezer door below the receptacle. A chute joins the second port of the upper hopper to the lower hopper for storing ice cubes therein.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
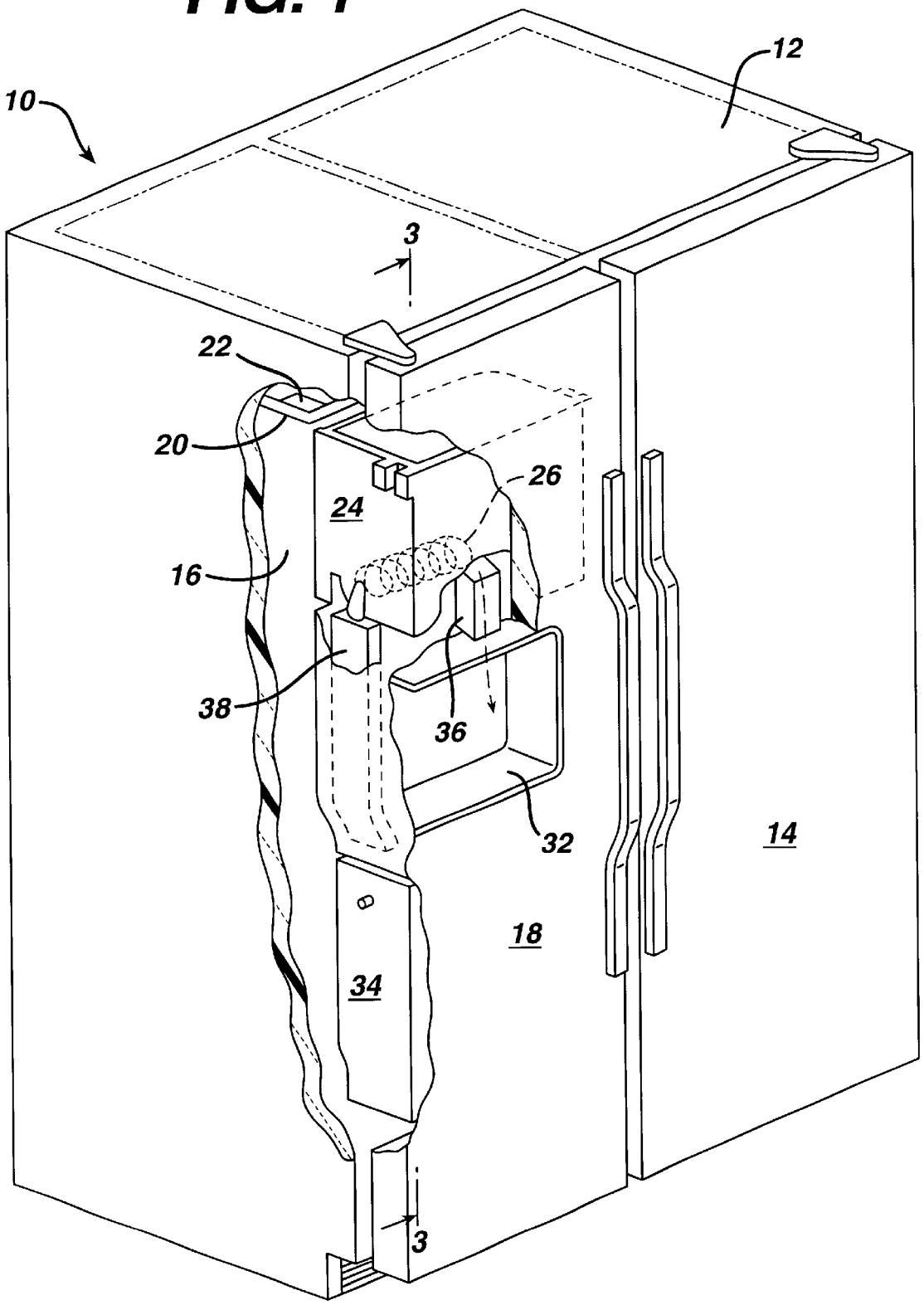
FIG. 1 is an isometric view of an exemplary side-by-side refrigerator including an icemaker in accordance with one embodiment of the present invention.

Illustrated in FIG. 1 is an exemplary side-by-side refrigerator 10 in accordance with an exemplary embodiment of the present invention. The refrigerator includes a refrigeration compartment 12 on the right side, with a corresponding access door 14 therefor, and a freezer compartment 16 on the left side, with a corresponding access door 18 therefor.

The compartments may have any conventional configuration, and are cooled by a common compressor which compresses a refrigerant, which is then expanded in a closed refrigeration loop for removing heat from inside the two compartments. The freezer compartment is configured for freezing and maintaining frozen typical food items placed therein for storage, with the refrigeration compartment being configured for maintaining cool, but not frozen, typical items placed therein.

An automatic icemaker 20 is fixedly disposed inside the freezer compartment in the top front portion thereof near the freezer door. The icemaker 20 may have any suitable configuration and typically includes an icetray with corresponding cavities configured for making ice cubes 22 of any suitable shape, such as crescent shape. The icemaker is connected to a water supply line which automatically fills the icetray when required for producing new batches of ice cubes. Frozen ice cubes are ejected from the icetray by rotating tines in any conventional manner.

Figure 2:
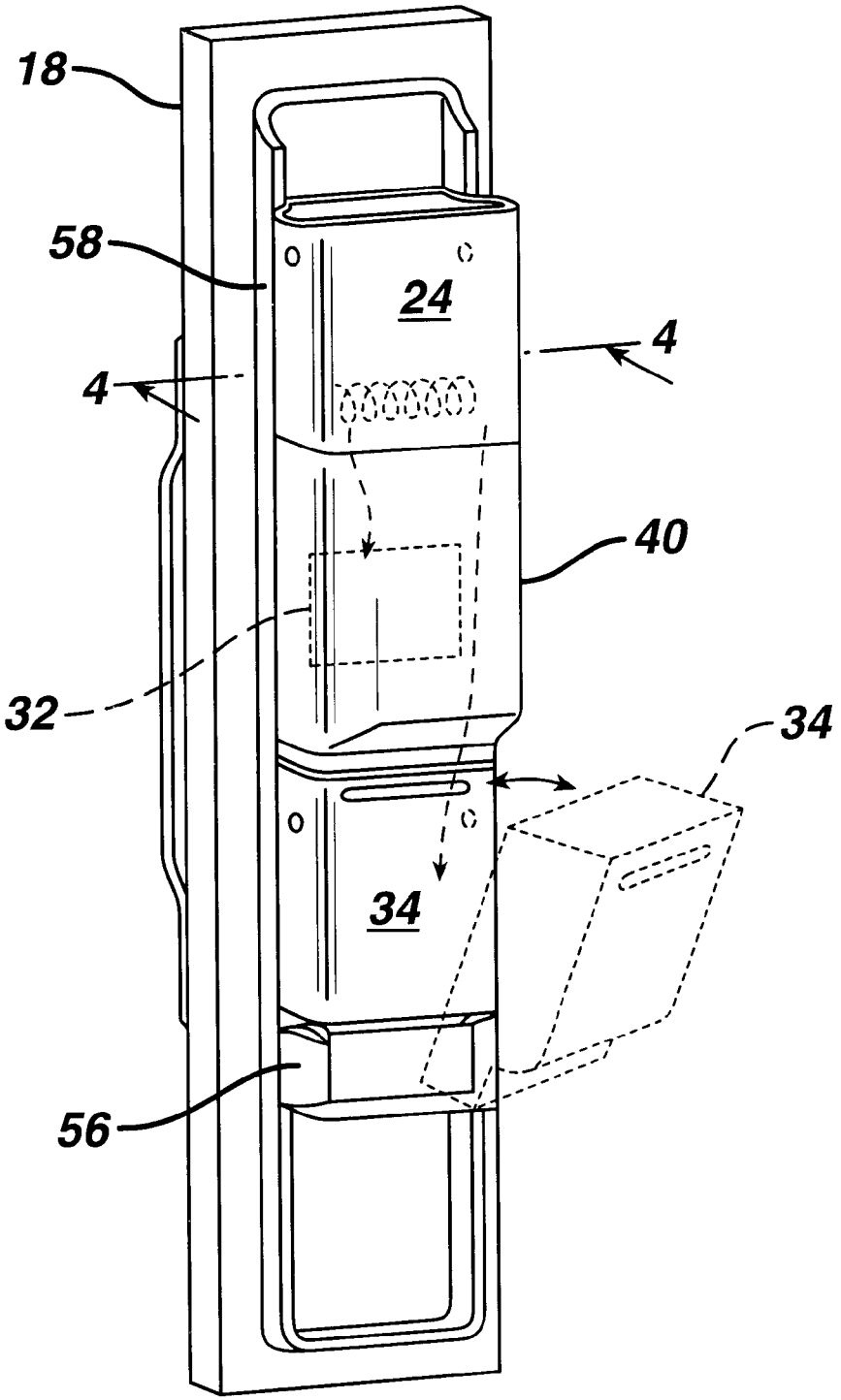
FIG. 2 is an isometric inside view of the freezer door illustrated in FIG. 1.

Whereas a conventional icemaker cooperates with an integral hopper mounted inside the freezer compartment, the icemaker 20 illustrated in FIG. 1 cooperates with an upper hopper 24 disposed inside the freezer door 18 directly below the icemaker. The icemaker remains fixed in the freezer compartment for producing the ice cubes, with the upper hopper 24 being attached to the freezer door and becomes accessible when the freezer door is opened as illustrated in FIG. 2.

Figure 3:
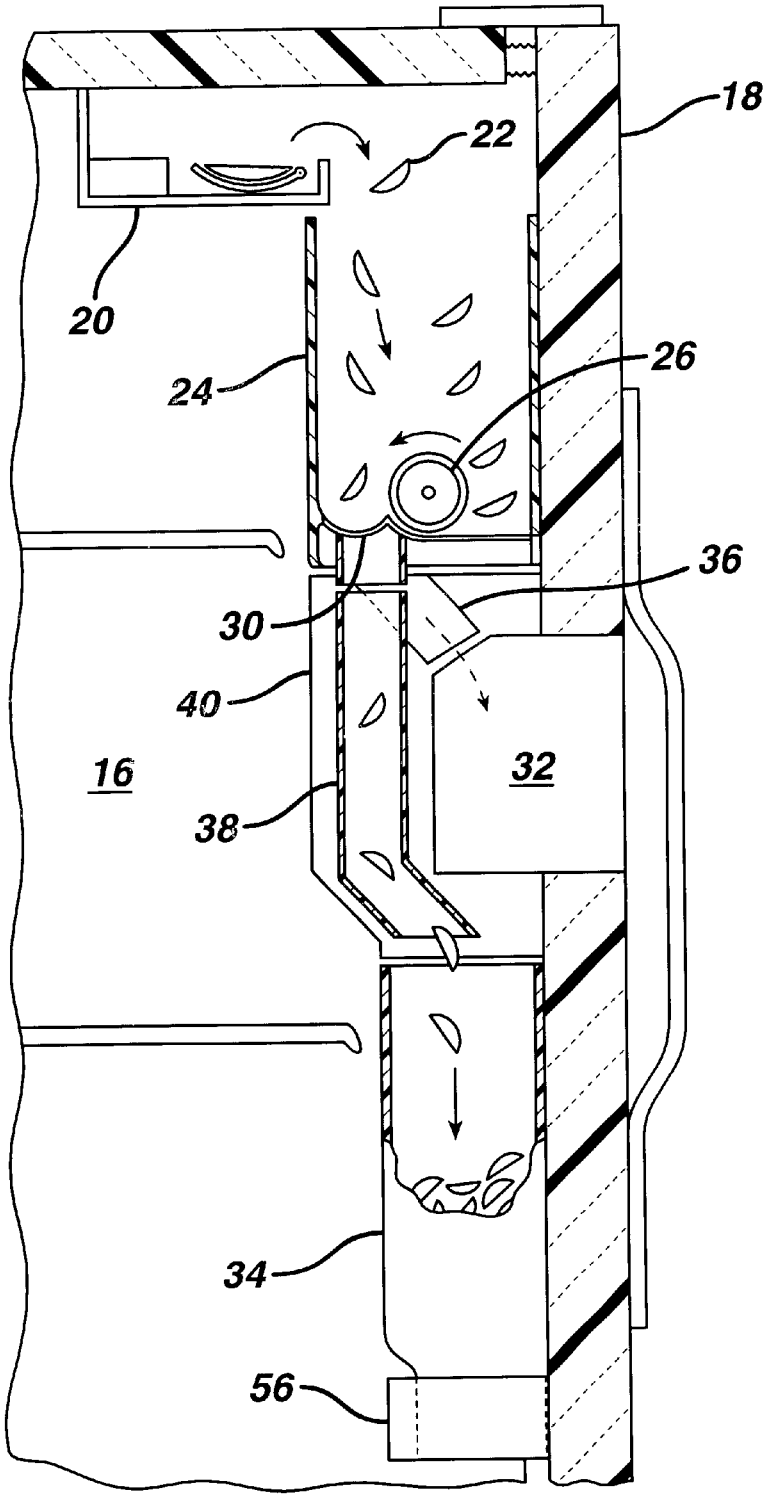
FIG. 3 is a vertical sectional view through the freezer door illustrated in FIG. 1 and taking along line 3—3.
Figure 4:
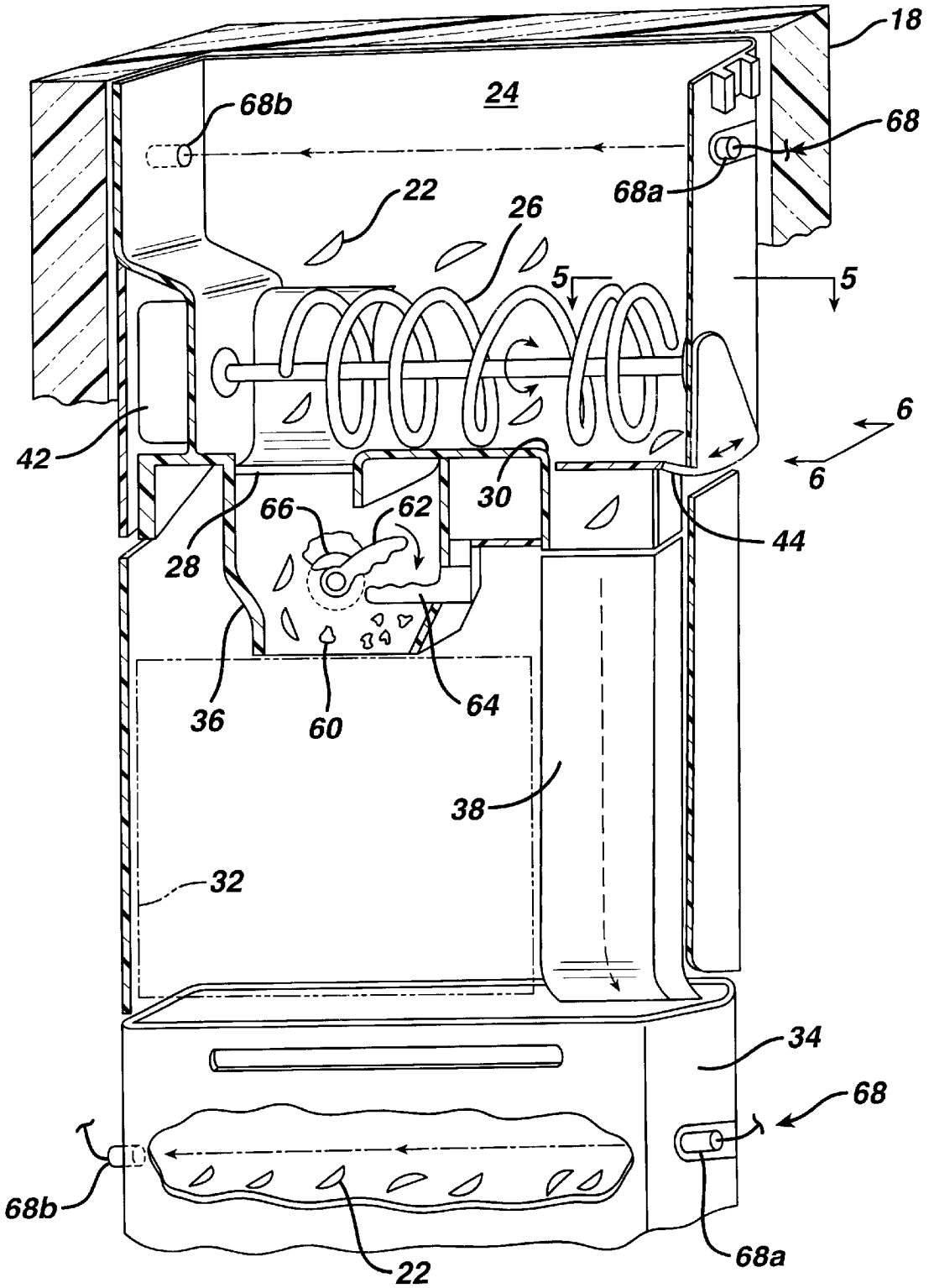
FIG. 4 is a vertical sectional view through the upper portion of the freezer door illustrated in FIG. 2 and taken generally along line 44.

The upper hopper 24 is illustrated in more detail in FIGS. 3 and 4, and is in the form of a suitable container with an open top, and a rotary metal auger 26 rotationally mounted horizontally in the bottom of the upper hopper. As best illustrated in FIG. 4, the hopper also includes first and second ice ports 28, 30 disposed in the bottom surface of the hopper vertically below the axially opposite ends of the auger.

As shown in FIGS. 1 and 3, a convenience receptacle 32 is disposed outside the freezer door and is suitably recessed therein below the upper hopper 24. The receptacle is provided for dispensing chilled water in any conventional manner, as well as for dispensing ice cubes from the upper hopper when desired without opening the freezer door.

A lower hopper 34 is disposed inside the freezer door 18 as illustrated in FIG. 14 directly below the convenience receptacle 32 in a vertically stacked configuration therewith, and with the upper hopper 24 being at the top of the stack 23

As shown in FIGS. 1, 3, and 4, a first chute 36 joins the first port 28 of the upper hopper to the top of the receptacle 32 for dispensing on demand ice cubes from the upper hopper. And, a separate second chute 38 joins the second port 30 of the upper hopper directly to the lower hopper 34 for storing in bulk ice cubes therein.

The various components of the two hoppers, two chutes, and receptacle may be formed of suitable plastic normally used in refrigerator construction. As shown in FIG. 2, the upper and lower hoppers 24, 34 are vertically stacked inside the freezer door 18 and are separated by the convenience receptacle 32 which is covered on the inside of the door by a plastic cover 40 for providing a substantially continuous and smooth assembly of components suitably mounted to the inside of the freezer door.

The two hoppers 24, 34 are provided for conveniently storing the ice cubes therein for ready access upon opening of the freezer door. Since water must be frozen in the icemaker 20 illustrated in FIG. 3 to form the ice cubes, the icemaker is preferably fixedly mounted inside the freezer compartment 16 so that the forming ice is not moved or disturbed upon opening of the freezer door. After the ice is made it is ejected into the top of the upper hopper 24, which is conveniently sized for storing a sufficient amount of ice cubes for dispensing through the receptacle 32 when desired. Extra storage capacity for bulk ice cubes is provided by the lower hopper 34 mounted below the receptacle.

The compact arrangement of the upper and lower hoppers mounted inside the freezer door illustrated in FIGS. 2 and 3 minimizes the overall volume required therefor, and minimizes any unused spaces associated with the icemaker and storage hoppers. In this way, more useful volume is provided inside the freezer compartment 16 itself for storing frozen items therein, while ice cubes are readily available to the user by convenient access through either the outside receptacle 32 or from inside the freezer door when it is opened.

As illustrated in FIG. 4, means in the exemplary form of a reversible electric motor 42 are suitably mounted to the upper hopper 24 and joined to the proximal end of the rotary auger 26 for rotation thereof to dispense the ice cubes 22 either through the left first port 28 or the right second port 30 when desired. The motor is preferably electrically joined to a suitable switch mounted inside the receptacle for dispensing on demand into the receptacle ice cubes when desired.

More specifically, the motor 42 is energized for rotating the auger 26 in a first or counterclockwise direction as illustrated in FIGS. 3 and 4 for dispensing the ice cubes through the first port 28 and cooperating first chute 36 for discharge through the externally exposed receptacle 32. The motor 42 may also be energized to rotate in an opposite second or clockwise direction for dispensing the ice cubes through the second port 30 and the cooperating second chute 38 to fill the lower hopper 34.

Since the auger 26 has a typical spiral configuration, rotation in the first direction pushes the stored ice cubes to the left in FIG. 4 for discharge by gravity through the first port 28. And, reverse rotation of the auger 26 pushes the ice cubes to the right in FIG. 4 for discharge by gravity through the second port 30, with the ice cubes falling by gravity into the lower hopper 34 by passage through the second chute 38.

As illustrated in FIG. 3, the externally exposed receptacle 32 extends in back part inside the freezer door 18 to provide sufficient access area in the relatively thin door for inserting a cup or other suitable container in which to receive the dispensed ice. The recessed receptacle 32 and its surrounding cover 40 vertically separate the upper and lower hoppers 24, 34, and the second chute 38 therefore extends vertically past the receptacle between the upper and lower hoppers for providing a direct ice carrying path therebetween.

As initially illustrated in FIG. 4, a trap door or rotary shutter 44 is preferably joined to the distal end of the auger for rotation therewith, and is disposed between the second port 30 and the second chute 38 for selectively blocking or unblocking the ice path therebetween for dispensing ice cubes from the upper hopper through the second chute to the lower hopper when desired. The shutter 44 may be selectively opened when required to fill or refill the lower hopper 34 to its maximum level. And, the upper hopper 24 may accumulate ice cubes to its maximum level so that both hoppers are normally filled and ready for use when desired.

Figure 5:
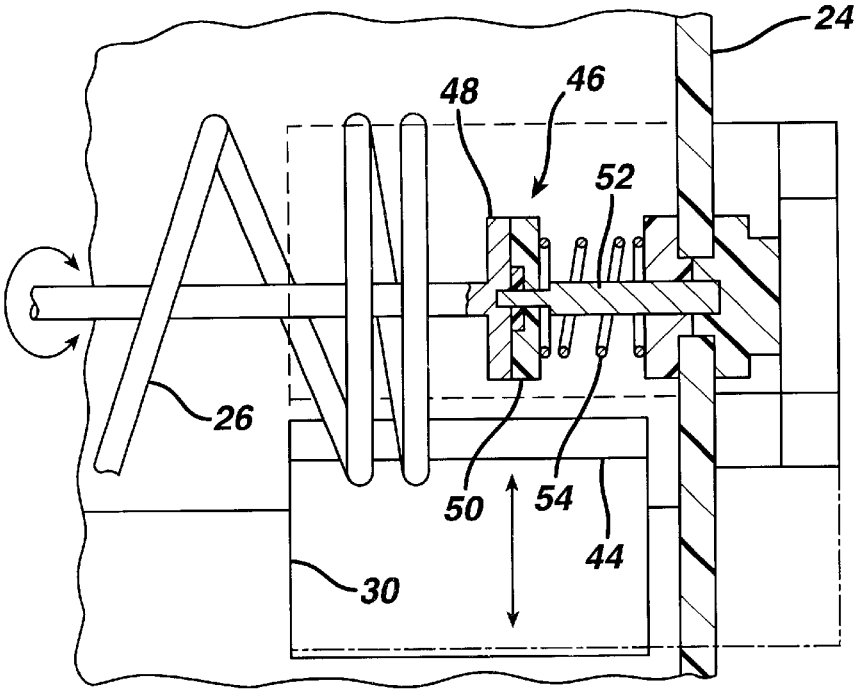
FIG. 5 is an enlarged top sectional view through a portion of the upper hopper illustrated in FIG. 4 and taken along line 5—5.
Figure 6:
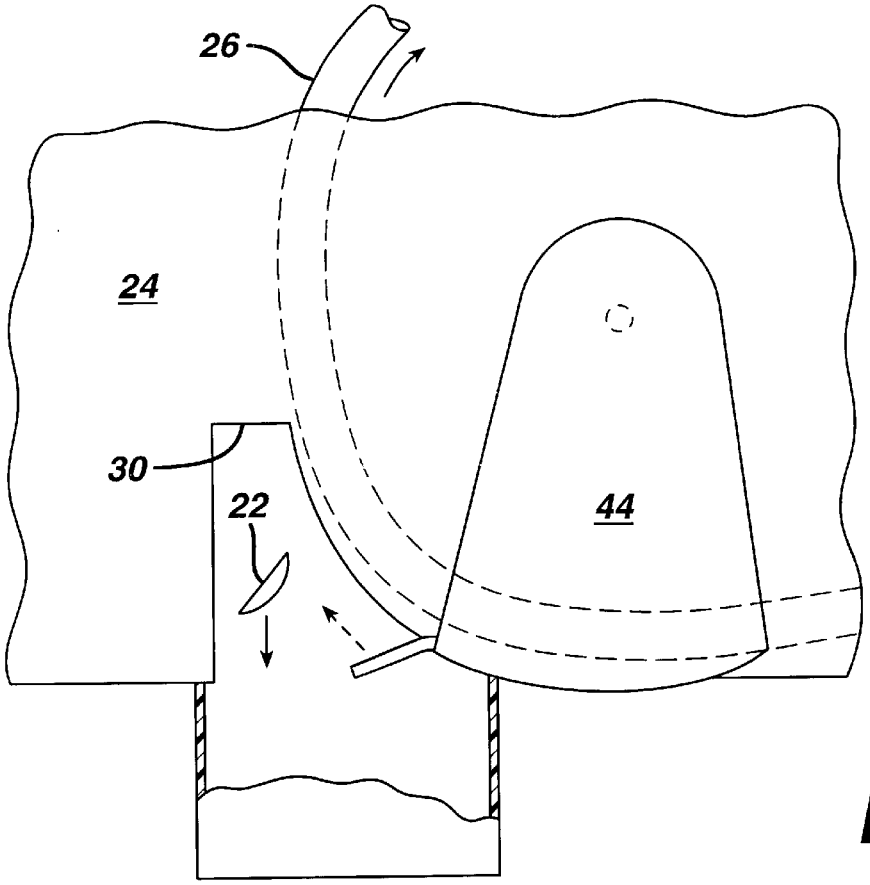
FIG. 6 is an elevational view of a rotary shutter joined to the upper hopper illustrated in FIG. 4 and taken along line 6—6.

As illustrated in FIG. 5, means in the form of a friction clutch 46 are preferably used for frictionally joining the shutter 44 to the distal end of the center shaft of the auger 26 for positioning the shutter to opposite rotary positions to selectively open and close the second port 30 without restraining rotation of the auger itself. The shutter 44 is illustrated in its counterclockwise open position in FIGS. 5 and 6 for unblocking the second port 30 for providing unobstructed passage to the second chute for dropping ice cubes into the lower hopper.

The shutter 44 includes a radial arm axially joined to the auger shaft, and an axially extending arcuate flap which blocks or unblocks the second port 30 as the shutter is rotated. Rotation of the shutter 44 clockwise from its counterclockwise open position in FIG. 6 will close or obstruct the second port 30 for retaining the ice cubes inside the upper hopper.

Since the total angular travel of the shutter between its open and closed positions is a small acute angle, the friction clutch 46 illustrated in FIG. 5 permits continuous rotation of the auger as required for dispensing the ice cubes through either of the two outlet ports 28, 30, without the shutter preventing that rotation. The friction clutch may take any suitable form such as that illustrated in FIG. 5 and includes a first disk pad 48 fixedly joined to the distal end of the center shaft of the auger 26.

A cooperating second disk pad 50 is loosely mounted to one end of a spindle 52 which is rotatably mounted in a suitable bushing through an end wall of the upper hopper 24. The pad end of the spindle is preferably pilot mounted in the center of the first pad 48, and a compression spring 54 is disposed behind the second pad 50 and against an opposing side of the bushing to bias the second pad in friction engagement with the first pad. The shutter 44 is fixedly attached to the opposite end of the spindle 52 for rotation therewith.

In this way, the shutter 44 is mounted to the spindle 52 and is driven by frictional engagement between the two pads 48, 50. When the shutter 44 reaches either of the two opposite extremes of travel along the second port 30 illustrated in FIG. 6, the shutter flap abuts corresponding portions or stops provided in the upper hopper, and continued rotation of the auger is permitted by frictional slippage in the clutch 46, while the shutter remains at its corresponding open or closed position depending upon the rotation direction of the auger.

The inter-hopper second chute 38 illustrated in FIG. 3 provides direct filling of the lower hopper 34 with ice from the upper hopper 24 when required for permitting dual hopper operation of the icemaker assembly. A particular advantage of the lower hopper 34 is that the lower hopper is simply a light weight container or ice bucket in which ice cubes may be stored in bulk for removal when desired. The freezer door preferably includes a suitable lower cradle 56 in the form of brackets, and the lower portion of the lower hopper is sized to fit within the lower cradle 56. In this way, the lower hopper 34 may be inserted into the lower cradle 56 as illustrated in FIG. 2 for mounting therein during normal operation, and readily removed therefrom by being simply lifted out from the freezer door.

Correspondingly, the freezer door illustrated in FIG. 2 preferably also includes an upper cradle 58 in the from of vertically extending side rails configured for receiving the upper hopper 24 therein for support atop the recessed receptacle 32. The upper hopper 24 is therefore also readily removable from the freezer door for dumping the accumulated ice cubes therein, or for occasionally cleaning the various parts thereof including the auger 26 therein when required. Since the electrical motor 42 is mounted inside the upper hopper, suitable quick disconnect electrical contacts are preferably provided therewith for permitting complete detachment of the upper hopper from the freezer door when desired.

As illustrated in FIG. 4, actuation of the auger 26 for dispensing the ice cubes through the first port 28 may provide whole ice cubes into the receptacle 32 when desired. Means in the form of an ice cube crusher 60 are suitably mounted within the first chute 36 below the first port 28 for dispensing crushed ice to the receptacle when desired. Ice crushers are conventionally known, and the crusher 60 may be conventionally configured for use in this new application.

For example, the crusher 60 includes a rotary blade 62 which cooperates with suitably mounted stationary blades 64 inside the first chute 36 for crushing the ice cubes therebetween. A suitable second electrical motor 66 is mounted between the lower end of the upper hopper in the inside of the freezer door for rotating the rotary blade 62 when desired for producing the crushed ice. When not rotating, the rotary blade 62 is positioned to permit unobstructed gravity feed of whole ice cubes into the receptacle.

The level of ice cubes in both hoppers may be detected in any suitable manner, such as by measuring weight of the ice filled hoppers or detecting the elevation of the ice therein. For example, means 68 in the exemplary form of an optical detector may be provided in each of the two hoppers 24, 34 illustrated in FIG. 4 for detecting whether those hoppers are filled with ice cubes to the intended maximum level therein.

The corresponding optical detectors 68 are preferably mounted near the top of the two hoppers so that when ice fills those hoppers to a suitable maximum level, the ice level is detected for preventing either more ice delivery into the lower hopper or into the upper hopper.

Each optical detector 68 preferably includes a light beam emitter 68*a* optically aligned with a cooperating photodiode 68*b* on opposite sides of the upper and lower hoppers. The emitter 68*a* may be a conventional light emitting diode (LED) emitting infrared light for example. And, the photodiode 68*b* is configured for detecting the IR light from the emitters. In this way, when each hopper is suitably filled with ice, the ice will obstruct the emitted light for changing the electrical signal from the photodiode. 44 The optical detectors are suitably joined in an electrical circuit with the icemaker and the auger motor to prevent the further dispensing of ice to either or both of the dual hoppers when they are suitably filled with ice.

The optical detectors may be conveniently located in the freezer door near the tops of the corresponding hoppers so that the individual hoppers may be removed without electrical connection to the door. For example, the detectors may be mounted directly to the freezer door, with suitable access windows being provided through the walls of the hoppers for detecting the ice level therein.

The dual hoppers described above permit all of the ice handling components to be mounted inside the freezer door in a compact arrangement for maximizing available space inside the freezer compartment itself. Ice storage is distributed between the dual hoppers, with the lower hopper providing dedicated bulk ice storage, conveniently accessible upon opening the freezer door, and readily removable therefrom.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

What is claimed is:

1. A refrigerator comprising:

a refrigeration compartment and access door therefor;

a freezer compartment and access door therefor;

an automatic icemaker disposed in said freezer compartment for making ice cubes;

an upper hopper disposed inside said freezer door below said ice maker, and including a rotary auger and first and second ice ports below axially opposite ends thereof;

a receptacle disposed outside said freezer door below said upper hopper;

a lower hopper disposed inside said freezer door below said receptacle; and a first chute joining said first port to said receptacle for dispensing ice cubes, a second chute joining said second port to said lower hopper for storing said ice cubes; and a reversible motor jointed to said auger for rotating said auger in a first direction for dispensing said ice cubes through said first port and chute, and in an opposite direction for dispensing said ice cubes through said second port and chute.

2. A refrigerator according to claim 1 wherein said receptacle extends inside said freezer door and vertically separates at upper and lower hoppers, and said second chute extends vertically past said receptacle between said upper and lower hoppers.

3. A refrigerator according to claim 2 further comprising a rotary shutter joined to said auger for rotation therewith, and disposed between said second port and chute for selectively dispensing ice cubes from said upper hopper through said second chute to said lower hopper.

4. A refrigerator according to claim 3 wherein said shutter is coaxially joined to said auger by a friction clutch for positioning said shutter to selectively open and close said second port without restraining rotation of said auger.

5. A refrigerator according to claim 4 wherein said friction clutch comprises:

a first pad fixedly joined to said auger;

a second pad mounted to one end of a spindle rotatably mounted in said upper hopper, with said shutter being mounted to an opposite end of said spindle; and a compression spring disposed behind said second pad to bias said second pad in friction engagement with said first pad.

6. A refrigerator according to claim 3 wherein said freezer door includes a lower cradle, and said lower hopper is removably disposed inside said lower cradle.

7. A refrigerator according to claim 3 wherein said freezer door includes an upper cradle and said upper hopper is removably disposed inside said upper cradle.

8. A refrigerator according to claim 3 further comprising a selectively operable ice cube crusher disposed below said first port for dispensing crushed ice to said receptacle.

9. A refrigerator according to claim 8 wherein said crusher includes a rotary blade selectively driven by a second motor.

10. A refrigerator according to claim 3 wherein said lower hopper includes a detector mounted near the top thereof for detecting whether said lower hopper is filled with said ice cubes.

11. A refrigerator according to claim 10 wherein said detector includes a light beam emitter optically aligned with a photodiode on opposite sides of said lower hopper.

12. A refrigerator according to claim 3 wherein said upper hopper includes a detector mounted near the top thereof for detecting whether said upper hopper is filled with said ice cubes.

13. A refrigerator according to claim 12 wherein said detector includes a light beam emitter optically aligned with a photodiode on opposite sides of said upper hopper.

14. A refrigerator comprising:

a freezer compartment and access door therefor;

an automatic icemaker disposed in said freezer compartment for making ice cubes;

an upper hopper disposed inside said freezer door below said icemaker, and including a rotary auger and first and second ice ports below axially opposite ends thereof;

a receptacle disposed outside said freezer door below said upper hopper, in flow communication with said first port;

a lower hopper disposed inside said freezer door below said receptacle;

a chute joining said second port to said lower hopper for storing said ice cubes; and means for selectively rotating said auger in a first direction for dispensing said ice cubes through said first port, and in an opposite second direction for dispensing said ice cubes through said second port and chute.

15. A refrigerator according to claim 14 further comprising a rotary shutter joined to said auger for rotation therewith, and disposed between said second port and chute for selectively dispensing ice cubes from said upper hopper through said chute to said lower hopper.

16. A refrigerator according to claim 15 further comprising means for frictionally joining said shutter to said auger for positioning said shutter to selectively open and close said second port without restraining rotation of said auger.

17. A refrigerator according to claim 16 further comprising means for detecting whether said upper and lower hoppers are filled with said ice cubes.

18. A refrigerator according to claim 17 further comprising means for selectively crushing said ice cubes dispensed from said first port.

19. A refrigerator according to claim 14 wherein said freezer door includes a lower cradle, and said lower hopper is removably disposed inside said lower cradle.

* * * * *